US008229146B2

(12) United States Patent
Nielsen

(10) Patent No.: US 8,229,146 B2
(45) Date of Patent: Jul. 24, 2012

(54) HEARING AID WITH ADAPTIVE DATA RECEPTION TIMING

(75) Inventor: Ivan Riis Nielsen, Farum (DK)

(73) Assignee: GN ReSound A/S, Ballerup (DK)

( * ) Notice: Subject to any disclaimer, the term of this patent is extended or adjusted under 35 U.S.C. 154(b) by 679 days.

(21) Appl. No.: 12/293,235

(22) PCT Filed: Mar. 8, 2007

(86) PCT No.: PCT/DK2007/000116

§ 371 (c)(1),
(2), (4) Date: Mar. 30, 2009

(87) PCT Pub. No.: WO2007/104308

PCT Pub. Date: Sep. 20, 2007

(65) Prior Publication Data

US 2009/0245551 A1 Oct. 1, 2009

Related U.S. Application Data

(60) Provisional application No. 60/783,342, filed on Mar. 16, 2006.

(30) Foreign Application Priority Data

Mar. 16, 2006 (DK) ..... 2006 00371

(51) Int. Cl.
*H04R 25/00* (2006.01)

(52) U.S. Cl. ..... 381/315; 381/316

(58) Field of Classification Search ..... 381/315, 381/316

See application file for complete search history.

(56) References Cited

U.S. PATENT DOCUMENTS

| | | | | |
|---|---|---|---|---|
| 5,155,479 | A | 10/1992 | Ragan | |
| 5,613,211 | A | 3/1997 | Matsuno | |
| 2004/0066944 | A1 * | 4/2004 | Leenen et al. | 381/314 |
| 2004/0146043 | A1 | 7/2004 | Hiraoka | |

FOREIGN PATENT DOCUMENTS

| | | | |
|---|---|---|---|
| JP | 06 350586 | A | 12/1994 |
| JP | 7 255082 | A | 10/1995 |
| JP | 2003 163646 | A | 6/2003 |
| WO | 0207479 | A1 | 1/2002 |
| WO | 2004 110099 | A2 | 12/2004 |
| WO | 2004110099 | A2 | 12/2004 |
| WO | 2005076664 | A1 | 8/2005 |
| WO | 2005101731 | A2 | 10/2005 |
| WO | 2007 104308 | A1 | 9/2007 |

OTHER PUBLICATIONS

Japanese Office Action for Japanese Application No. 2008-558637, Dated Jan. 10, 2012.
English Abstract for Japanese Application 06-350586.
Written Opinion for Application No. PCT/DK2007/000116, Dated Jun. 25, 2007.
International Search Report for Application No. PCT/DK2007/000116, Dated Jun. 25, 2007.

* cited by examiner

*Primary Examiner* — Benjamin Sandvik
*Assistant Examiner* — Whitney T Moore
(74) *Attorney, Agent, or Firm* — Vista IP Law Group, LLP

(57) ABSTRACT

A hearing aid with a communication circuit for wireless communication, the circuit includes a receiver for reception of data, and a communication controller that is configured for determining a delay between a receiver activation and an actual start of reception of data, and adjusting a next receiver activation in accordance with the determined delay.

9 Claims, 4 Drawing Sheets

HEARING AID WITH ADAPTIVE DATA RECEPTION TIMING

RELATED APPLICATION DATA

Figure 1:
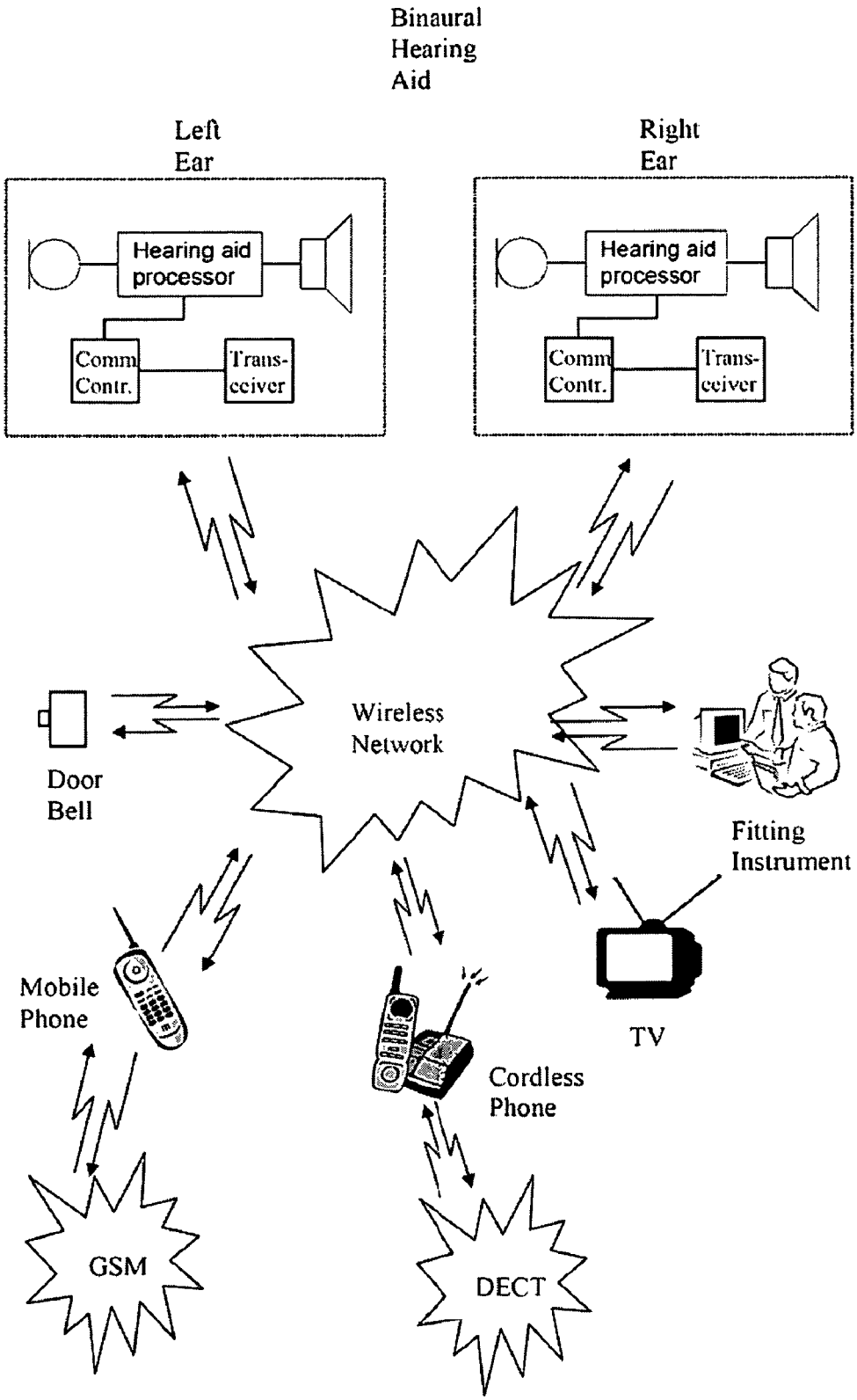

This application is a national stage of International Application No. PCT/DK2007/000116, which claims priority to, and the benefit of, Danish Patent Application No. PA 2006 00371, filed on Mar. 16, 2006, and U.S. Provisional Patent Application No. 60/783,342, filed on Mar. 16, 2006, the entire disclosure of all of which is expressly incorporated by reference herein.

FIELD

The present application relates to a hearing aid with a communication circuit for wireless reception of signals.

BACKGROUND AND SUMMARY

WO 2004/110099 discloses a hearing aid wireless network with a communication protocol that is simple thereby requiring a small amount of code and with low power consumption during operation. Further, the acquisition time is low, and the latency is low.

The disclosed hearing aid comprises a transceiver for interconnection of the hearing aid with a wireless network for communication with a plurality of other devices, and a communication controller that is adapted for controlling data exchange through the network in accordance with the communication protocol.

In one of the disclosed embodiments, the transceiver and communication controller operate according to a time division multiplex access scheme (TDMA) wherein the time is divided into numbered time slots and different devices in the network communicate, e.g. receive data, in specific respective time slots.

In accordance with some embodiments, data communication is performed in a device by division of the time into numbered time slots. Different devices communicate, e.g. receive data, in specific respective time slots. In order to lower power consumption in a hearing aid that is adapted to receive signals in a specific time slot, the hearing aid receiver is turned on only in its time slot. However, with finite accuracy of the clock signals used to control timing, various devices cannot synchronize the time slots with complete accuracy, e.g. a receiving device may not agree with a transmitting device on when to start reception. This means that some margin is needed, which again means that a conventional hearing aid communication circuit is powered on during a larger time period than the respective time slot.

A more accurate timing would lower power consumption, however conventionally; this solution requires incorporation of bulky components (crystals).

The embodiments described herein provide a less bulky solution. According to some embodiments, the hearing aid starts reception of data from the network with a required margin before its time slot, and then it determines the delay until the first data is actually received i.e. the start of the received data frame is detected, and the delay is recorded. At the next occurrence of the time slot, start of reception is adjusted, i.e. advanced or delayed, in accordance with the value determined during reception in the previous time slot. In the following, start of possible reception of data is also denoted "receiver activation". Thus, upon receiver activation, receiver circuitry is turned on so that the receiver is capable of receiving data. This increases receiver power consumption.

Upon termination of data reception, the receiver circuitry is turned off, so that receiver power consumption is lowered again.

Thus, according to some embodiments, the above-mentioned and other objects are obtained by provision of a hearing aid with a communication circuit for wireless communication, the circuit comprising a receiver for reception of data, and a communication controller. The communication controller is adapted for controlling data reception and determining the delay between receiver activation and actual start of reception of data followed by adjusting the next receiver activation in accordance with the determined delay.

In accordance with some embodiments, a hearing aid with a communication circuit for wireless communication, the circuit includes a receiver for reception of data, and a communication controller that is configured for determining a delay between a receiver activation and an actual start of reception of data, and adjusting a next receiver activation in accordance with the determined delay.

Thus, it is an important advantage that a hearing aid may communicate with a low power consumption adequately supplied by, e.g., conventional $ZnO_2$ batteries.

DESCRIPTION OF THE DRAWING FIGURES

Figure 2:
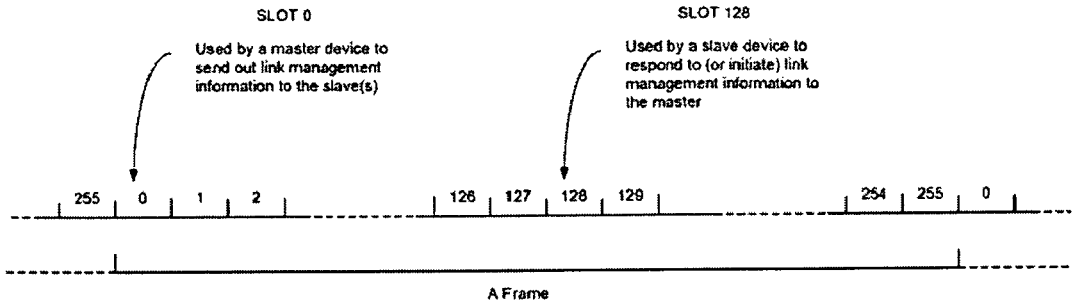
Figure 3:
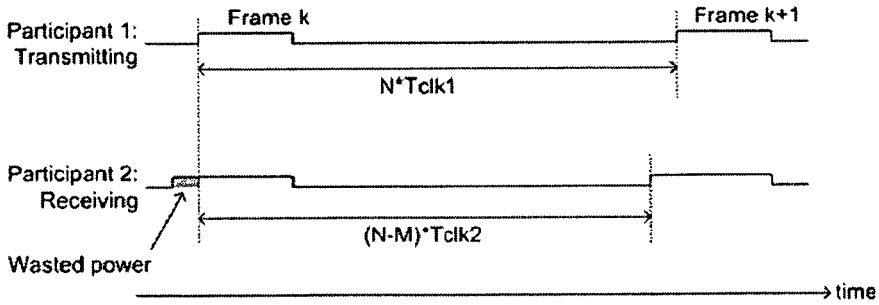
Figure 4:
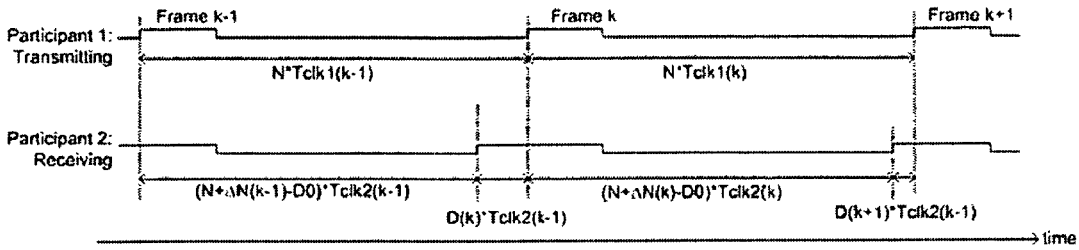
Figure 5:
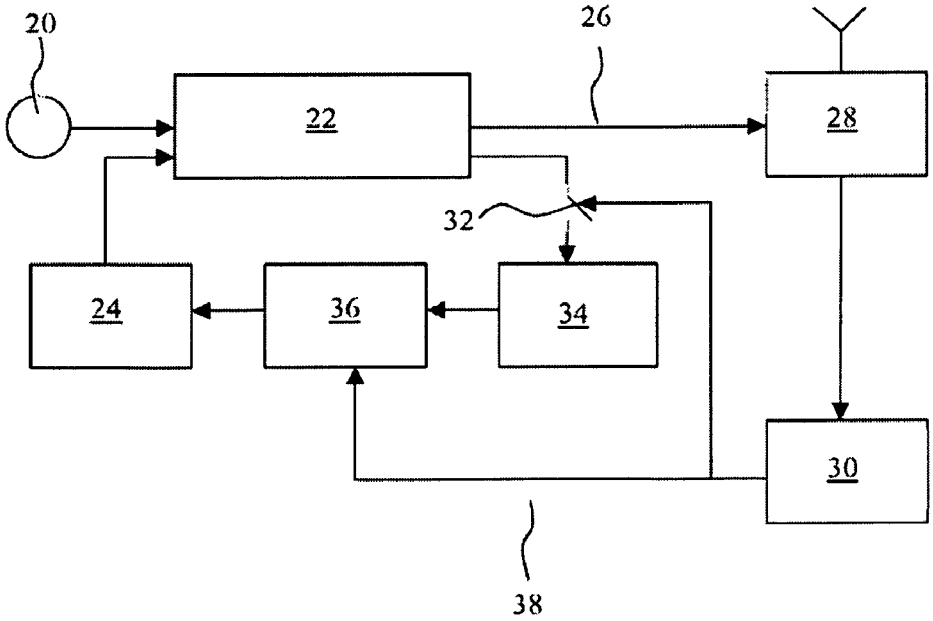
Figure 6:
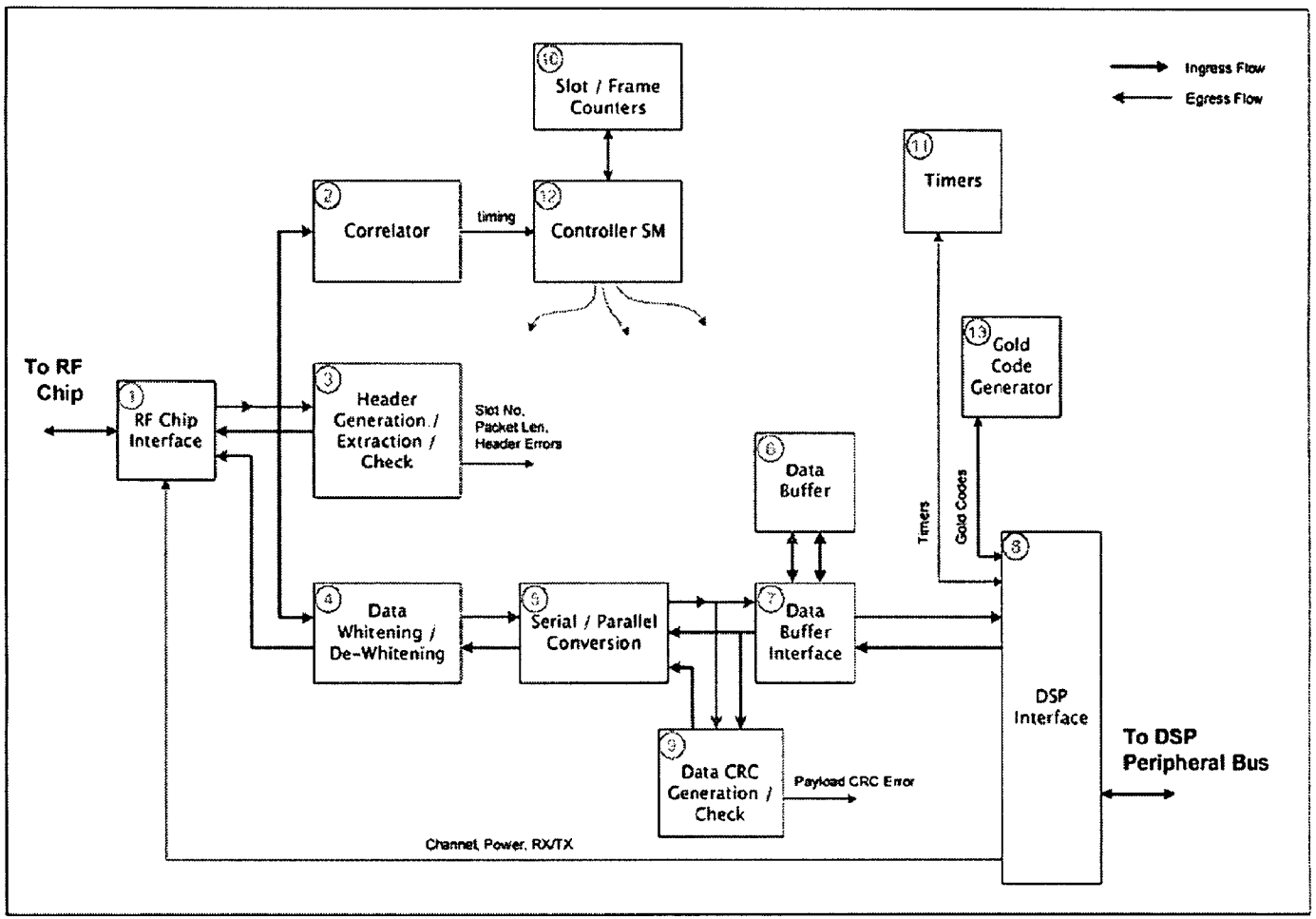

The above and other features and advantages of the present embodiments will become more apparent to those of ordinary skill in the art by describing in detail exemplary embodiments thereof with reference to the attached drawings in which:

FIG. 1 schematically illustrates a hearing aid coupled to a wireless network, FIG. 2 illustrates slots and frames, FIG. 3 illustrates conventional slot timing, FIG. 4 illustrates slot timing according to some embodiments, FIG. 5 illustrates functional blocks of the communication controller according to some embodiments, and FIG. 6 is a blocked schematic of a transceiver and communication controller according to the some embodiments.

DETAIL DESCRIPTION

The embodiments will now be described more fully hereinafter with reference to the accompanying drawings, in which exemplary embodiments are shown. The invention may, however, be embodied in different forms and should not be construed as limited to the embodiments set forth herein. Rather, these embodiments are provided so that this disclosure will be thorough and complete, and will fully convey the scope of the application to those skilled in the art. Like reference numerals refer to like elements throughout. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

A hearing aid wireless network according to some embodiments facilitates interconnection of a plurality of devices in the network, such as hearing aids, remote controllers, fitting instruments, mobile phones, headsets, door bells, alarm systems, broadcast systems, such as tele coil replacement, etc, etc.

In one embodiment, the receiver and communication controller operate according to a frequency diversification or spread spectrum scheme, i.e. the frequency range utilized by the network is divided into a number of frequency channels, and transmissions switch channels according to a predetermined scheme so that transmissions are distributed over the frequency range. According to the present embodiments, a frequency hopping algorithm is provided that allows devices in the network to calculate what frequency channel the network will use at any given point in time without relying on the history of the network, e.g. based on the present frequency channel number, a pseudo-random number generator calculates the next frequency channel number. This facilitates synchronization of a new device in the network, e.g. the new device comprises the same pseudo-random number generator as the devices already connected in the network. Thus, upon receipt of the current frequency channel number during acquisition, the new device will calculate the same next frequency channel number as the other devices in the network. Preferably, one device in the network is a master device. All other devices in the system synchronize to the timing of the master device, and preferably, the master device is a hearing aid, since the hearing aid user will always carry the hearing aid when he or she uses the network.

Every device in the network has its own identification number, e.g. a 32-bit number. Globally unique identities are not required since the probability of two users having hearing instruments with identical identifications is negligible.

Preferably, a new device is automatically recognized by the network and interconnected with the network.

During initial synchronization, e.g. during acquisition, i.e. the process of initially establishing a network and the process of a new device establishing connection with an existing network, upon turn-on of the hearing aid, upon manual activation of synchronization, upon automatic periodic initiation of synchronization, etc, the slave device may listen during repeated periods. If nothing is received during the period, the next period is awaited, and if something is received, the slave device continues reception for 1½ frame before a determination of the delay is performed.

It is an advantage of a network operating according to a spread spectrum scheme that the communication has a low sensitivity to noise, since noise is typically present in specific frequency channels, and communication will only be performed in a specific frequency channel for a short time period after which communication is switched to another frequency channel.

Further, several networks may co-exist in close proximity, for example two or more hearing aid users may be present in the same room without network interference, since the probability of two networks simultaneously using a specific frequency channel will be very low. Likewise, the hearing aid network may coexist with other wireless networks utilizing the same frequency band, such as Bluetooth networks or other wireless local area networks. Hearing aids according to the present embodiments may advantageously be incorporated into a binaural hearing aid system, wherein two hearing aids are interconnected through the wireless network for digital exchange of data, such as audio signals, signal processing parameters, control data, such as identification of signal processing programs, etc, etc. and optionally interconnected with other devices, such as a remote control, etc.

FIG. 1 schematically illustrates a binaural hearing aid according to the present embodiments with a left ear hearing aid and a right ear hearing aid, each of which has a transceiver and communication controller for connection with a wireless network interconnecting the two hearing aids, and interconnecting the hearing aids and a plurality of other devices in the wireless network. In the example illustrated in FIG. 1, a doorbell, a mobile phone, a cordless phone, a TV-set, and a fitting instrument are also connected to the wireless network.

A network is a means of interconnecting a set of devices for communication of data between the devices. According to the present embodiments, one of the devices in the network act as a master device, i.e. it transmits timing information to the other devices in the network for synchronization. Thus, the master device controls the timing of the devices. The other devices are slave devices.

An ID identifies every device. The ID is unique within the network.

The illustrated device operates in the 2.4 GHz industrial scientific medical (ISM) band. It comprises 80 frequency channels of 1 MHz bandwidth. A frequency hopping TDM scheme is utilized. During acquisition, the frequency hopping scheme comprises a reduced number of frequency channels, e.g. less than 16 channels, preferably 8 channels, for faster acquisition. Members of the reduced set of frequency channels are denoted acquisition channels. Preferably, the acquisition channels are distributed uniformly throughout the frequency band utilised by the network.

According to the protocol and as shown in FIG. 2, the time is divided into so-called slots that have a length of 1250 μs (twice the length of a minimum Bluetooth™ slot). The slots are numbered from 0 to 255.

256 slots, i.e. slot 0 to slot 255, constitute a frame. Frames are also numbered.

Among factors influencing selection of the length of a slot, is the required lower latency of the system and a desired low overhead with respects to headers and PLL locking. Preferably, the slot length is a multiple of 625 μS, facilitating (i.e. not prevent) that the protocol can be implemented on BLUETOOTH™ enabled devices.

Each slot (except slot 128) is used for transmission by one specific device so that data collisions inside the network are prevented. Any slave device may transmit data in slot 128 and hence collisions may occur in this slot. The master device transmits timing information in slot 0. The slot and frame counters of a slave device are synchronized with the respective counters of the master device of the network.

A device may use one or more slots for transmission of data. Slots may be allocated during manufacture of a given device, or, slots may be allocated dynamically during acquisition. Preferably, the allocation table is stored in the master device.

According to the time-division-multiple-access (TDMA) frame structure, the devices in a network transmit and receive data according to a coordinated time schedule wherein the time is divided into numbered time slots and different devices in the network communicate, e.g. receive data, in specific respective time slots. In order to lower power consumption in the hearing aid, the hearing aid transceiver is turned on only in its time slot. Further, the bit rate can be made scalable in such a system: When low bit transfer rates are required, the transceiver need only be active a small fraction of the time. In this way power can be saved.

However, with finite accuracy of the clock signals used to control timing, various devices connected to the wireless network cannot synchronize the time slots with complete accuracy, e.g. a receiving participant in the network may not agree with a transmitting participant on when to start reception. This means that some margin is needed, which again means that conventional hearing aid network circuitry is powered on during a larger time period than the respective time slot. This is illustrated in FIG. 3.

In FIG. 3, N represents the frame length in units of clock periods. Transmitting "Participant 1" determines the frame length based on its own clock period $T_{CLK1}$. "Participant 2" must be turned on in time to receive the data transmitted in frame k+1, and it measures time using its own clock period $T_{CLK2}$ relative to the time where the previous frame k actually started. It counts N−M periods before starting the receiver, where M represents a necessary margin. The largest timing difference may occur with a minimum $T_{CLK1}$ equal to $T_{CLK}-\Delta T_{CLK}$, and a maximum $T_{CLK2}$ equal to $T_{CLK}+\Delta T_{CLK}$ in which case:

$$N\cdot(T_{CLK}-\Delta T_{CLK})>(N-M)\cdot(T_{CLK}+\Delta T_{CLK})\Rightarrow$$
$$M>2\cdot N\cdot\frac{\Delta T_{CLK}}{T_{CLK}+\Delta T_{CLK}}\cong N\cdot\frac{2\cdot\Delta T_{CLK}}{T_{CLK}}$$

This requirement determines the minimum allowable margin M. If for example, the clock periods vary up to ±5%, "Participant 2" will typically turn the receiver on one tenth of a frame period before necessary. Typically, the current consumption of the transceiver circuitry is app. 1 mA at a 1.2 V battery supply voltage, i.e. the extra margin of 10% leads to an extra power consumption of 0.1 mA*1.2 V=0.12 mW which amounts to app 7%-10% of the power consumption of the hearing aid.

FIG. 4 illustrates the lowering of the timing margin and thereby the power consumption according to some embodiments wherein the receiving device adjust its frame timing to match that of the transmitting participant.

In FIG. 4

- N is a constant representing the nominal frame length in units of clock periods.
- $T_{CLK1}(k)$ is the average period of clock generator in Participant 1', measured during the $k^{th}$ frame.
- $T_{CLK2}(k)$ is the average period of clock generator in "Participant 2", measured during the $k^{th}$ frame.
- ΔN(k) is a variable representing an estimated (adapted) length correction of the $k^{th}$ frame measured in units of $T_{CLK2}(k)$.
- $D_0$ is a target delay, which is the amount of time that the receiver should be turned on before the actual frame start, measured in units of clock periods.
- D(k) is a measured time interval from when "Participant 2" was turned on until the $k^{th}$ frame actually started, measured in units of $T_{CLK2}(k-1)$.

In the illustrated embodiment, ΔN(k) is continuously updated on the basis of observed D(k) which should approach $D_0$. Furthermore, it is understood that ΔN(k) may be positive or negative corresponding to an increase or a decrease in the count value. A first order algorithm may be used to update ΔN(k):

$$\Delta N(k)=\Delta N(k-1)+a_0\cdot(D(k)-D_0$$

where $a_0$ is a constant typically in the 0.5-1.5 range. If $a_0$ has a value close to 0.5, then the adaptation will be slow, and the updates will not be influenced by short transients or fluctuations in the oscillator, but will substantially follow the secular drift of the hearing aid oscillator. In such a situation it may be advantageous with a larger target delay $D_0$.

However, in some types of hearing aids it may be of critical importance to be able to handle quick variations of the hearing aid oscillator frequency. Generally the oscillator frequency in a hearing aid will depend on the battery voltage. For example, it may be of importance to use larger values of $a_0$ (e.g. $a_0$=1.5) when the hearing aid output is varying frequently between high and low sound pressures leading to supply voltage fluctuations, which again lead to oscillator frequency fluctuations. A larger value of $a_0$ will also permit the usage of a lower target delay $D_0$. In praxis the selection of the value of $a_0$ may be based on a trade-off between a desired low value of the target delay to ensure optimal power saving and speed of adaptation.

Preferably, ΔN(k) is updated according to $$\Delta N(k)=\sum_{i=1}^{M_b}b_i\cdot\Delta N(k-i)+\sum_{i=0}^{M_a}a_i\cdot(D(k-i)-D_0)$$

where $a_0$–$a_{ma}$ and $b_1$–$b_{Mb}$, are filter constants. The dynamic behavior is determined by these constants. According to the above equation, the adjustment ΔN(k) at time k depends recursively on previous adjustments and previous errors. In a preferred embodiment, the filter constants are selected so that the most resent adjustments and errors influence the adjustment the most. For example $(a_i)_{i=0}^{Ma}$ may be a decreasing sequence of numbers, whereby older errors are given less importance than newer ones.

The dynamic behavior of this algorithm will now be described using the z-transform. First, the D(k) error in time units is determined by:

$$E(k)\equiv T_{CLK2}(k)\cdot(D(k+1)-D_0)$$
$$=N\cdot T_{CLK1}(k)-(N+\Delta N(k))\cdot T_{CLK2}(k)$$

Insertion of $$T_{CLK1}(k)=T_{CLK}+\frac{\Delta T_1(k)}{N}\text{ and }T_{CLK2}(k)=T_{CLK}+\frac{\Delta T_2(k)}{N},$$

where the $\Delta T_i(k)$ represents the frame period deviations from nominal leads to $$E(k)=\Delta T_1(k)-\Delta T_2(k)-\Delta N(k)\cdot\left(T_{CLK}+\frac{\Delta T_2(k)}{N}\right)\cong$$
$$\Delta T_1(k)-\Delta T_2(k)-\Delta N(k)\cdot T_{CLK}$$

Further:

$$\Delta N(k)=\sum_{i=1}^{M_b}b_i\cdot\Delta N(k-i)+\sum_{i=0}^{M_a}a_i\cdot(D(k-i)-D_0)$$
$$\cong\sum_{i=1}^{M_b}b_i\cdot\Delta N(k-i)+\sum_{i=0}^{M_a}a_i\cdot\frac{E(k-i-1)}{T_{CLK}}$$

Applying the z-transform and with an input timing error $\Delta T(k)\equiv\Delta T_1(k)-\Delta T_2(k)$ and output timing error E(z):

$$\Delta N(z)=\frac{\frac{1}{T_{CLK}}\cdot\sum_{i=0}^{M_a}a_i\cdot z^{-i-1}}{1-\sum_{i=1}^{M_b}b_i\cdot z^{-i}}\cdot E(z)$$

-continued $$E(z) = \Delta T(z) - \Delta N(z) \cdot T_{CLK}$$

$$= \Delta T(z) - \frac{\sum_{i=0}^{M_a} a_i \cdot z^{-i-1}}{1 - \sum_{i=1}^{M_b} b_i \cdot z^{-i}} \cdot E(z)$$

Solving for E(z):

$$\frac{E(z)}{\Delta T(z)} = \frac{1}{1 + \frac{\sum_{i=0}^{M_a} a_i \cdot z^{-i-1}}{1 - \sum_{i=1}^{M_b} b_i \cdot z^{-i}}}$$

$$= \frac{1 - \sum_{i=1}^{M_b} b_i \cdot z^{-i}}{1 - \sum_{i=1}^{M_b} b_i \cdot z^{-i} + \sum_{i=0}^{M_a} a_i \cdot z^{-i-1}}$$

The various parameters can be optimized to produce the optimal timing error rejection. Note that static errors are completely eliminated if $$\sum_{i=1}^{Mb} b_i = 1$$

(zero transfer for z=1).

FIG. 5 is a blocked diagram of functional blocks of one embodiment of a communication controller. FIG. 1 shows an oscillator 20, which for example may oscillate at 2 MHz. The oscillator 20 is connected to a Timer 22, which counts the number of clock cycles. The Timer 22 is also connected to a max count unit 24, which initially may be supplied with the number N.

When the Timer 22 has counted N clock cycles, a signal 26 is supplied to a radio 28, which triggers activation of the radio 28 so that the radio starts "listening" to the transmitting device (not shown). The radio 28 then supplies a bit stream to the SOF (Start Of Frame) correlator 30, which is able to recognize a given "start of frame" bit message. Before the transmitting device starts transmission, this bit stream is nonsense. But when the SOF unit recognizes the "start of frame" bit message the Latch contact 32 is activated, so that the Timer 22 is able to write the value D to the Latch 34.

The value D is the Timer 22 count from the time at which the start of radio 28 signals has been sent. Thus D is a measure of the time the slave frame is behind the master frame.

The frame-timing device is additionally equipped with a MCU (Micro Control Unit) 36, which is supplied with a software program. The MCU 36 is able to read the value D from the Latch 34.

Substantially simultaneously as the SOF correlator 30 sends the signal to the Latch contact 32, another interrupt signal 38 is sent to the MCU 36. This interrupt signal 38 tells the MCU 36 to start the algorithm. This algorithm uses the stored D value as input, and the software program uses this value D to update the clock cycle number N by a number ΔN. This value ΔN is supplied to the max count unit 24 and added to the number N.

During the next cycle, the timer 22 counts N+ΔN cycles, before the "start radio" message is sent.

The max count unit 24 may be an integrated part of the Timer 22, and the Latch contact 32 may also be an integrated, built-in, part of the Latch 34.

In another embodiment, the oscillator is made adjustable and the controller is adapted to adjust the oscillator frequency in accordance with the determined delay between receiver activation and actual start of reception of data to minimize the receiver activation margin.

In yet another embodiment, the oscillator provides the clock signal to the timer by division of one of its output signals, and the controller is adapted to adjust the division ration in accordance with the determined delay between receiver activation and actual start of reception of data to minimize the receiver activation margin.

FIG. 6 is a blocked schematic of a transceiver and communication controller according to some embodiments. FIG. 6 also illustrates the major data flow into and out of the units. At data reception, the RF chip interface 1 sends SPI commands to the RF chip for configuration. The RF chip interface receives a data stream from the RF chip.

The correlator 2 extracts the slot and frame timing from the sync word, so that the rest of the receive chain can be synchronized. Based on this timing, the header extraction block 3 analyses the package header and extracts the slot number and package length. Any errors in the header are reported. The data de-whitening block 4 de-whitens the package data. The data is then converted to 16 bits parallel by the serial-parallel conversion block 5. The package data is stored in an internal data buffer 6 by the data buffer interface 7. The data is then accessible to the DSP via the DSP interface 8 through the peripheral bus. A CRC check can also be performed on the package data 9. All internal configuration registers and results of header checks, CRC errors etc are accessible though the DSP interface. Slot and frame counters 10 are also provided as well as a number of hardware timers 11.

The controller state machine 12 is responsible for overall timing of the base-band engine.

A gold code generator 13 provides hardware assistance to the software in order to generate gold codes used to program the sync words.

At transmission, the RF chip interface 1 sends SPI commands to the RF chip for configuration.

The DSP writes a package of data to the data buffer 6, 7 via the DSP interface 8. The package data has a CRC calculated via the data CRC generation block 9. The combined data payload and CRC are then converted to serial 5 and whitened 4. The package header is constructed by the header generation block 3 and then appended to the data. The completed package is then streamed to the RF chip by the RF chip interface 1.

While various embodiments have been described, it will be obvious to those skilled in the art that various changes and modifications may be made therein without departing from the invention.

The invention claimed is:

1. A hearing aid with a communication circuit for wireless communication, the circuit comprising:

a receiver for reception of data; and a communication controller that is configured for determining a delay between a receiver activation and an actual start of reception of data, and adjusting a next receiver activation in accordance with the determined delay.

2. The hearing aid according to claim 1, wherein the communication controller is configured to adjust the next receiver activation in accordance with a target delay.

3. The hearing aid according to claim 2, wherein the communication controller is configured to adjust the next receiver activation in accordance with previous adjustments and previous determined delays between respective previous receiver activation and previous actual start of reception of data.

4. The hearing aid according to claim 2, wherein the communication controller is configured to adjust the next receiver activation in accordance with previous adjustments or previous determined delays between respective previous receiver activation and previous actual start of reception of data.

5. The hearing aid according to claim 1, wherein the communication controller is configured to adjust the next receiver activation in accordance with previous adjustments and previous determined delays between respective previous receiver activation and previous actual start of reception of data.

6. The hearing aid according to claim 1, wherein the communication controller is configured to adjust the next receiver activation in accordance with previous adjustments or previous determined delays between respective previous receiver activation and previous actual start of reception of data.

7. The hearing aid according to any of the claims 1-6, wherein the communication controller further comprises an oscillator, a timer, and a counter, the oscillator is configured for providing a clock signal to the timer, and the timer is configured for activating the receiver at a specific count value, and wherein the communication controller is further configured to adjust the count value by an amount corresponding to the determined delay between the receiver activation and the actual start of reception of data.

8. The hearing aid according to any of the claims 1-6, wherein the communication controller further comprises an oscillator, a timer, and a counter, the oscillator is configured for providing a clock signal to the timer, and the timer is configured for activating the receiver at a specific count value, and wherein the communication controller is further configured to adjust a frequency of the oscillator in accordance with the determined delay between the receiver activation and the actual start of reception of data.

9. The hearing aid according to any of the claims 1-6, wherein the communication controller further comprises an oscillator, a timer, and a counter, the oscillator is configured for providing a clock signal to the timer by division of one of its output signals, and the timer is configured for activating the receiver at a specific count value, and wherein the communication controller is further configured to adjust a ratio of the division in accordance with the determined delay between the receiver activation and the actual start of reception of data.

* * * * *